US007775022B2

(12) United States Patent
Tardif et al.

(10) Patent No.: US 7,775,022 B2
(45) Date of Patent: Aug. 17, 2010

(54) METHOD FOR HANDLING A GAS TURBINE ENGINE DURING PACKAGING

(75) Inventors: Denis Tardif, Sainte-Julie (CA); Claude Giardetti, Saint-Bruno (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 43 days.

(21) Appl. No.: 11/875,976

(22) Filed: Oct. 22, 2007

(65) Prior Publication Data

US 2009/0104015 A1 Apr. 23, 2009

(51) Int. Cl.
*B65B 5/04* (2006.01)

(52) U.S. Cl. ..... 53/473; 53/235; 212/223

(58) Field of Classification Search ..... 53/473, 53/235; 212/223
See application file for complete search history.

(56) References Cited

U.S. PATENT DOCUMENTS 1,907,024 A * 5/1933 Willard et al. ..... 254/93 R
2,569,628 A * 10/1951 Craighead et al. ..... 52/120
2,674,371 A * 4/1954 Blackinton ..... 206/319
2,815,184 A * 12/1957 Irwin et al. ..... 244/54
2,825,477 A * 3/1958 Ross ..... 29/559
2,944,331 A * 7/1960 Munn ..... 29/281.4
3,554,395 A * 1/1971 Dunbar ..... 414/694
3,599,812 A * 8/1971 Hasstedt et al. ..... 414/563
3,638,805 A * 2/1972 Garnier ..... 212/175
3,828,941 A * 8/1974 Coutinho ..... 212/261
3,934,729 A * 1/1976 Wellman ..... 212/297
4,200,273 A * 4/1980 Das Gupta et al. ..... 269/61
4,257,493 A * 3/1981 Beckham ..... 187/262
4,479,632 A * 10/1984 McIntire et al. ..... 254/3 B
4,508,233 A * 4/1985 Helms ..... 212/294
4,523,888 A * 6/1985 Pezzner et al. ..... 414/680
4,770,304 A * 9/1988 Woods ..... 212/348
5,509,638 A * 4/1996 Leon-Vieito ..... 254/270
5,934,490 A * 8/1999 Mora ..... 212/176
6,485,247 B1 * 11/2002 Groves et al. ..... 414/589
6,581,908 B1 * 6/2003 Francis ..... 254/2 B
6,581,913 B1 * 6/2003 Conomos et al. ..... 254/133 R
7,103,952 B2 * 9/2006 Appleton et al. ..... 29/281.4
7,172,083 B1 * 2/2007 Raines ..... 212/261

OTHER PUBLICATIONS

Ingersoll Rand, Ergonomic Handling Systems, 2006.

* cited by examiner

*Primary Examiner*—Christopher Harmon
(74) *Attorney, Agent, or Firm*—Ogilvy Renault LLP

(57) ABSTRACT

The method is used for handing a gas turbine engine during packaging. The method comprises receiving the engine at a handling apparatus pivotally secured to the floor, removably connecting the engine to the handling apparatus, pivoting the engine while supported on the handling apparatus, lowering the engine into a container, and then removably connecting the engine to the container.

11 Claims, 3 Drawing Sheets

METHOD FOR HANDLING A GAS TURBINE ENGINE DURING PACKAGING

TECHNICAL FIELD

The technical field generally relates to the handling of gas turbine engines during their packaging in a container.

BACKGROUND

Oftentimes, small gas turbine engines are individually put in containers at a manufacturing or maintenance plant before being shipped elsewhere or stored. The gas turbine engines are moved within the plant on engine transport devices. They are then transferred to a fixed structure sometimes referred to as a "shipping post". The shipping post holds the engine while one or more technicians perform some tasks on the engine. This procedure, however, often require numerous transfers from the shipping post to other supporting devices in order for the various packaging tasks to be accomplished. These transfers are time-consuming and accordingly, often result in a loss of productivity. Room for improvements exists.

SUMMARY

In one aspect, the present concept provides a method for handing a gas turbine engine during packaging, the method comprising: receiving the engine at a handling apparatus pivotally secured to the floor; removably connecting the engine to the handling apparatus; pivoting the engine while supported on the handling apparatus; lowering the engine into a container; and then removably connecting the engine to the container.

In another aspect, the present concept provides a method for handing a gas turbine engine prior from being set in a container, the method comprising: removably connecting the engine to a rigid support of a handling apparatus, the apparatus being rotatable around a substantially vertical axis; disconnecting the engine from a structure holding the engine immediately before the handling apparatus; rotating the engine around the vertical axis of the apparatus; and then lowering the engine into the container.

In a further aspect, the present concept provides a method of packaging a gas turbine engine into a container, the method comprising: receiving the engine at a handling apparatus pivotally secured to the floor; transferring the engine to the handling apparatus; performing at least one packaging task on the engine and raising the engine at least once while the engine is continuously supported by the handling apparatus; and then transferring the engine directly into the container.

Further details of these and other aspects of the improvements will be apparent from the detailed description and figures included below.

DESCRIPTION OF THE FIGURES

Reference is now made to the accompanying figures depicting aspects of the improved method, in which.

DETAILED DESCRIPTION

Figure 1:
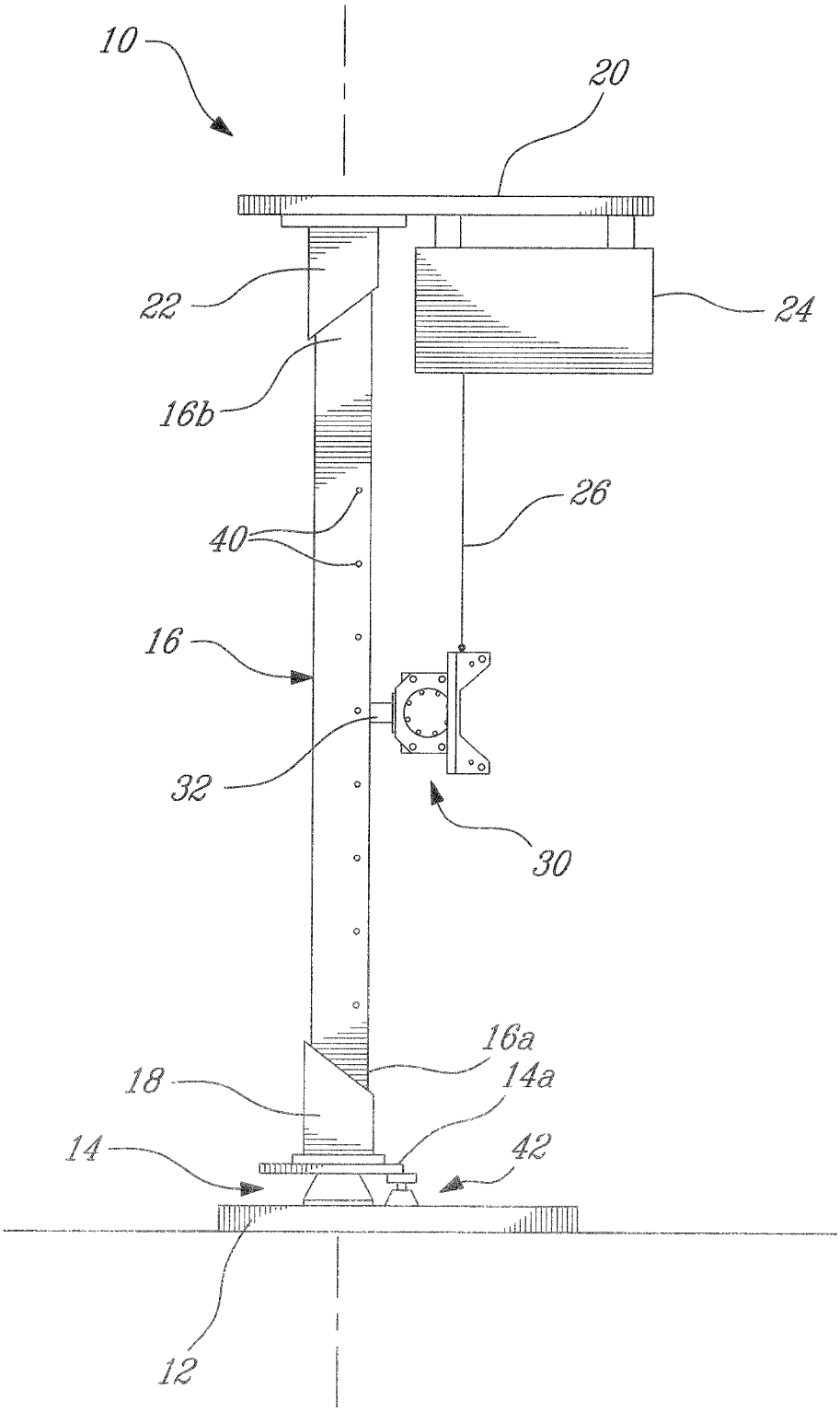
FIG. 1 is a semi-schematic side view of an example of an apparatus for handling a gas turbine engine in accordance with the improved method.

FIG. 1 shows an example of an apparatus 10 for handling a gas turbine engine during packaging. The gas turbine engines to be used with this apparatus 10 are relatively small in size. However, it could be designed to handle larger engines as well. The illustrated apparatus 10 is only one of many possible designs and accordingly, the method described herein is not limited for use with the handling apparatus 10 as shown.

It should be noted that the word "packaging" is a generic word designating the various tasks required to put an engine in a container, and may include the transfer of the engine from an engine transport device to the handling apparatus 10. These tasks can include, for example, draining fluids used in the engine during a bench test, installing plugs to cover openings, securing wires together, etc. A wide range of other tasks can be done as well. Once in the container, the engine can be, for instance, shipped elsewhere or stored while in the container. The engine in the container can be a fully-assembled engine or an engine in which some parts will be assembled later. Also, the word "handling" is a generic word designating the various steps of moving the engine during packaging.

The apparatus 10 shown as an example in FIG. 1 has a base 12 secured to the floor or to a similar solid structure. The base 12 can be in the form of a plate bolted to the floor. It holds a turntable 14 having a substantially vertical pivot axis. The turntable 14 has one end secured to the base 12 and other end that is attached to the bottom end 16*a* of a substantially vertical post 16 by means of a sleeve 18. The post 16 is rotatable around the vertical pivot axis. The apparatus 10 also comprises a substantially horizontal side arm 20 projecting from the post 16. In the illustrated embodiment, the side arm 20 projects from the upper end of the post 16. The connection between the post 16 and the side arm 20 can be made in a number of ways. In the illustrated example, the connection includes a sleeve 22 rigidly attached over the upper end 16*b* of the post 16. The side arm 20 is welded or otherwise attached to the sleeve 22.

A hoist 24 is provided on the side arm 20. The hoist 24 can include, for instance, a pneumatic motor mechanically connected to a reel supporting a chain or a sling. The illustrated example includes a sling 26.

Gas turbine engines often have two opposite integrated side plates by which the engine can be connected to another structure. The handling apparatus 10 comprises a rigid side support 30 having one end in sliding engagement with the post 16 and an opposite end that can be removably connected to one of the side plates of the engine through an engine mount. The support 30 is said to be rigid, which means that the support 30 is normally rigidly holding the engine in the same position. This facilitates the tasks of the technician or technicians. This does not exclude the possibility of having an adjustable support in which the orientation of the engine can be changed in accordance with one or more degrees of freedom. The connection of the side support 30 with the post 16 can include a flange 32 or another element that is operatively connected to the post 16. In the illustrated example, the flange 32 of the side support 30 is slidably connected to a vertically-extending slot (not shown) on the side of the post 16. The slot, the side arm 20 and the support 30 are in registry with each other. The support 30 is held by the sling 26 of the hoist 24, which sling has a free end attached to a hook or a hole provided on the support 30.

If desired, the post 16 can be provided with a plurality of spaced-apart horizontal holes 40 crossing the vertically-extending slot on the post 16. One or more pins can then be inserted below the support 30 to prevent the engine when one is connected to the support 30, from falling towards the floor in case of a failure of the hoist 24 or any of the parts to which it is connected.

A brake 42 can be used next to the base 12 to prevent the turntable 14, and thus all the other elements connected thereto, from rotating when that is not required. In the illustrated example, the brake 42 includes an actuator with a piston having an end engaging the bottom side of a disk 14*a* on the pivotable side of the turntable 14. The actuator of the brake 42 can be electric, pneumatic, hydraulic, etc.

Figure 2:
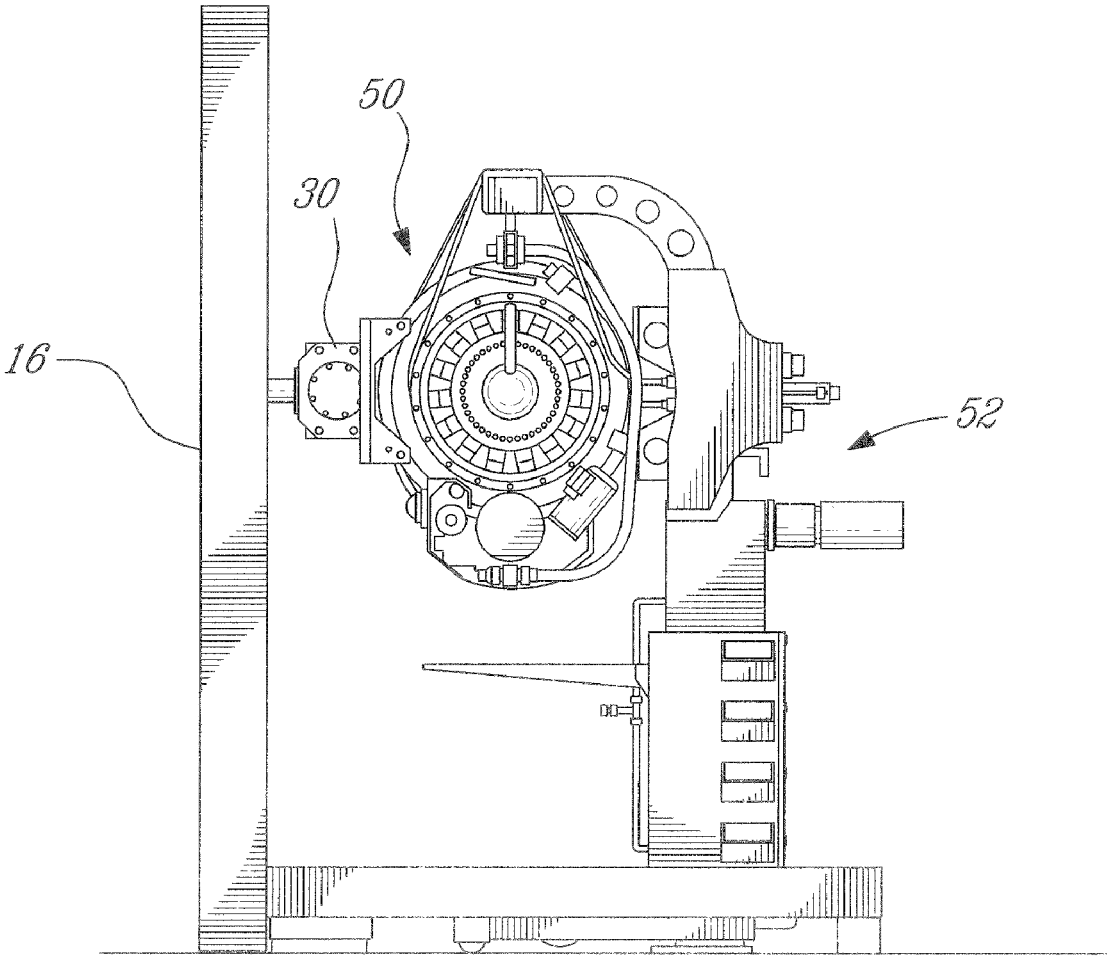
FIG. 2 is a schematic side view of an example of an engine being transferred from an engine transport device to an handling apparatus.
Figure 3:
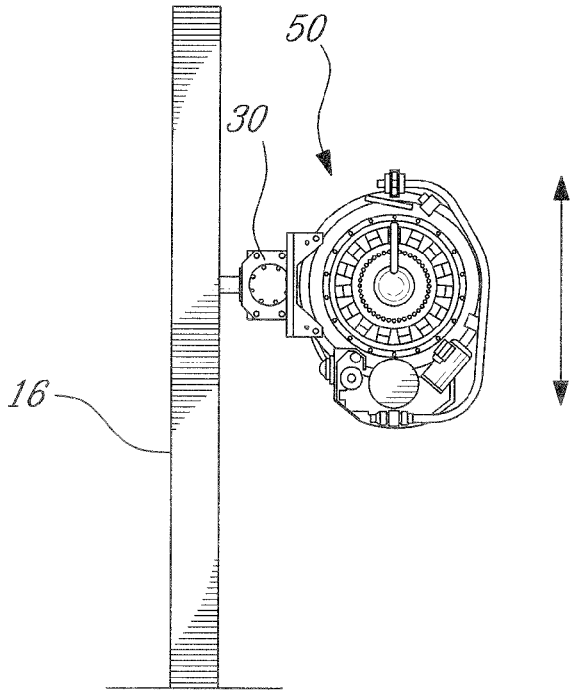
FIG. 3 is a view similar to FIG. 2, showing the engine being moved vertically on the handling apparatus.

FIGS. 2 to 5 show an example of a gas turbine engine being handled in accordance with the improved method. FIG. 2 shows an engine 50 being brought to an handling apparatus 10 using an engine transport device 52. The side of the engine 50 is removably connected to the support 30, using bolts for instance or another removable connector. Once connected to the apparatus 10, the engine 50 can be disconnected from the engine transport device 52 and the engine transport device 52 is moved away from the vicinity of the apparatus 10. The technician or technicians can then perform the tasks required to prepare the engine 50. The height of the engine 50 with reference to the floor can be changed, if and whenever required, as shown in FIG. 3.

Figure 4:
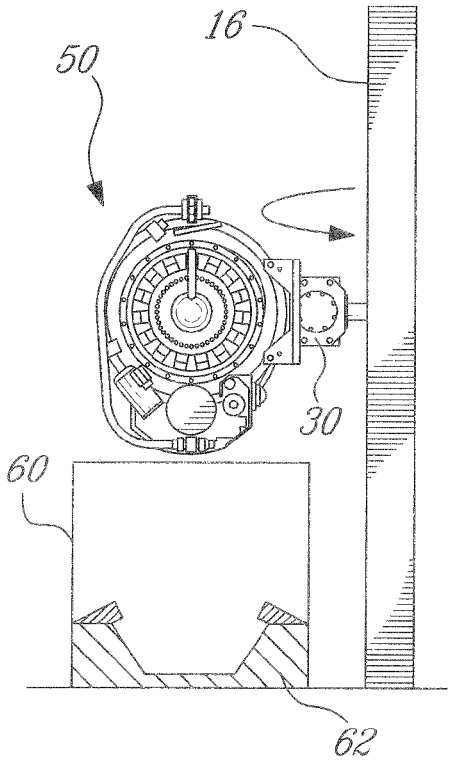
FIG. 4 is a view similar to FIG. 2, showing the engine being pivoted so as to be right above a corresponding container.

FIG. 4 shows the engine 50 immediately before being lowered into a corresponding container 60 opened at the top thereof. The container 60 is essentially a box designed to facilitate the handling of the engine 50 during shipping and prevent damage thereto, including during storage. The internal frame 62 of the container 60 can be designed to hold the engine 50 so as to prevent any movement thereof. It should be noted that the container 60 is only schematically illustrated in the figures and that a container may be designed with movable lids allowing the engine 50 to be completely encased in the container 60.

The container 60 is positioned on a side of the apparatus 10, such as that slide that is opposite the workspace provided for technician or technicians. The post 16 is then pivoted around the axis of the turntable 14 until the engine 50 be right above the desired location in the container 60.

Figure 5:
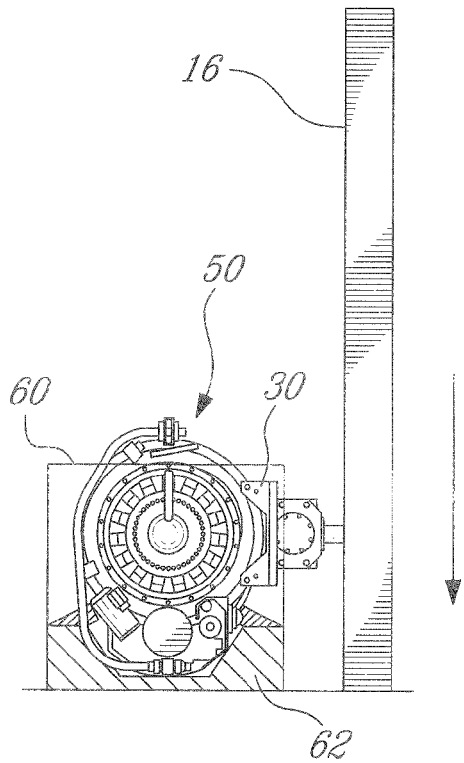
FIG. 5 is a view similar to FIG. 4, showing the engine being lowered into the container.

FIG. 5 shows the engine 50 after being lowered into the container 60. The engine 50 can then be bolted or otherwise secured to the frame 62 inside the container 60. The engine 50 is detached from the support 30 afterwards.

As can be appreciated, the new method of handling an engine minimises the transfer of the engine 50 to a bear minimum. The handling of the engine 50 is then more easy and efficient.

The above description is meant to be exemplary only, and one skilled in the art will recognize that changes can be made to what is described above without departing from the scope of the appended claims. For example, the hoist can be manually powered or powered using an electric or hydraulic motor. The hoist motor, if any, and its reel do not necessarily need to be provided on a side arm. It can be provided on the post itself, for instance, and the sling or chain can then reach the proper location on the side arm using one or more pulleys. Alternatively, the hoist can be in the form of a screw inside the post and engaged to a follower designed to move the support up or down. A side arm can then be omitted. The slot along the post and which receives the edge of the support can be replaced by an equivalent system, such as a slot in the support and which engages a vertical flange projecting on the side of the post, a carriage with rolls engaged around the post, etc. The brake at the bottom of the apparatus can include pins or similar fasteners to be inserted in corresponding holes so as to prevent the apparatus from rotating. Although it has been suggested in the detailed description that the engine be connected inside the container before disconnecting it from the support of the apparatus, thereby maintaining a constant attachment with a rigid structure at all time, it is possible to design the container so as to temporally support the engine while it is disconnected from the support and prior to connecting it to the container. Although the post is said to be vertical or substantially vertical, it can define a certain angle with the vertical. Similarly, a side arm connected to the post must not necessarily be horizontal and can define a certain angle with the horizontal. It is possible to have a portion of the support of the apparatus being detachable from the rest of the apparatus. This way, the detachable portion can remain with the engine in the container. The engine transport device may be different than that shown in FIG. 2. Still other modifications will be apparent to those skilled in the art, in light of a review of this disclosure, and such modifications are intended to fall within the appended claims.

What is claimed is:

1. A method for handling a gas turbine engine during packaging, the method comprising:

receiving the engine at a handling apparatus having a post pivotally secured to the floor for rotation about a generally vertical axis fixed with respect to the ground;

rigidly connecting the engine to a support fixed to the post in rotation along, the vertical axis of the handling apparatus, away from a container;

pivoting the engine while supported on the handling apparatus by pivoting the post of the handling apparatus about the vertical axis fixed with respect to the ground until the engine is in vertical register with the container;

lowering the engine into the container by translating the support in the handling apparatus; and then removably connecting the engine to the container.

2. The method as defined in claim 1, further comprising:

disconnecting the engine from an engine transport device after removably connecting the engine to the handling apparatus.

3. The method as defined in claim 1, further comprising:

raising at least once the engine with reference to the floor using the support of the handling apparatus.

4. The method as defined in claim 1, further comprising:

disconnecting the engine from the handling apparatus after having removably connected the engine to the container.

5. A method for handling a gas turbine engine prior from being set in a container, the method comprising:

rigidly connecting the engine to a support of a handling apparatus, the apparatus having a post upon which the support is fixed in rotation along a vertical axis, the post being rotatable around the substantially vertical axis fixed with respect to the ground, away from the container;

disconnecting the engine from a structure holding the engine immediately before the handling apparatus;

rotating the engine around the vertical axis of the apparatus fixed with respect to the ground until the engine is in vertical register with the container; and then lowering the engine into the container by translating the support along the handling apparatus.

6. The method as defined in claim 5, wherein the structure includes an engine transport system.

7. The method as defined in claim 5, wherein disconnecting the engine from the apparatus includes removing the support from the engine.

8. The method as defined in claim 5, further comprising:

raising at least once the engine with reference to the floor using the handling apparatus.

9. The method as defined in claim 5, further comprising:

removably connecting the engine to the container.

10. A method of packaging a gas turbine engine into a container, the method comprising:

receiving the engine at a handling apparatus having a post pivotally secured to the floor for rotation about a generally vertical axis fixed with respect to the ground;

rigidly connecting the engine to a support of the handling apparatus, away from the container, the support being fixed to the post in rotation along the vertical axis;

performing at least one packaging task on the engine and raising the engine at least once by translation of the support while the engine is continuously supported by the handling apparatus;

pivoting the engine while supported on the handling apparatus by pivoting the handling apparatus about the vertical axis fixed with respect to the ground until the engine is in vertical register with the container; and then transferring the engine directly into the container.

11. The method as defined in claim 10, wherein transferring the engine into the container includes removably connecting the engine to the container.

* * * * *